United States Patent [19]

Lapointe, deceased et al.

[11] Patent Number: 4,478,374

[45] Date of Patent: Oct. 23, 1984

[54] CHIP THICKNESS SEPARATOR

[76] Inventors: Joseph A. Lapointe, deceased, late of Pointe Claire, Canada; by June Lapointe, executrix, 233 Springdale Ave., Pointe Claire, Canada

[21] Appl. No.: 360,827

[22] Filed: Mar. 23, 1982

[51] Int. Cl.[3] ..... B02C 7/08

[52] U.S. Cl. ..... 241/261.2; 209/545; 209/666

[58] Field of Search ..... 209/539–541, 209/545, 660, 666, 683, 691, 701, 308, 625; 241/28, 79, 261.2, 261.3

[56] References Cited

U.S. PATENT DOCUMENTS

| | | | |
|---|---|---|---|
| 1,051,877 | 2/1913 | Gabbett-Fairfax | 209/660 |
| 3,926,380 | 12/1975 | Musgrove et al. | 241/261.2 |
| 4,068,759 | 1/1978 | Abdul-Rabman | 209/691 |
| 4,093,127 | 6/1978 | Alberts et al. | 241/275 |
| 4,235,382 | 11/1980 | Smith | 241/28 |
| 4,372,495 | 2/1983 | Marton et al. | 241/28 |

*Primary Examiner*—Robert B. Reeves
*Assistant Examiner*—Donald Hajec

[57] ABSTRACT

Materials such as wood chips are classified by thickness by feeding same through a chip outlet onto a rotating disc adjacent the axis of rotation of the disc, the disc cooperating with a housing to define a tapering passage terminating in a narrow, restricted outlet adjacent the periphery of the disc, orienting bars project from the disc and extend radially from the axis of rotation to beyond the chip inlet. A frusto conical chip orienting surface extends from the radial outward extremities of the orienting bars toward the outlet in a position traversing the path of material leaving the orienting bars.

In one embodiment, an oversized outlet is provided, positioned trailing the orienting bars in the direction of rotation behind a substantially unobstructed trajectory of material leaving the orienting bars. In another embodiment, the oversized outlets are replaced by breaker bars that cooperate with cooperating breaker bars on the housing to shear positions of the material away. And in yet another embodiment, the cooperating breaker bars are replaced by breaking bars on the disc and cutting blades on a housing to shave the wood chips and reduce their thickness.

9 Claims, 13 Drawing Figures

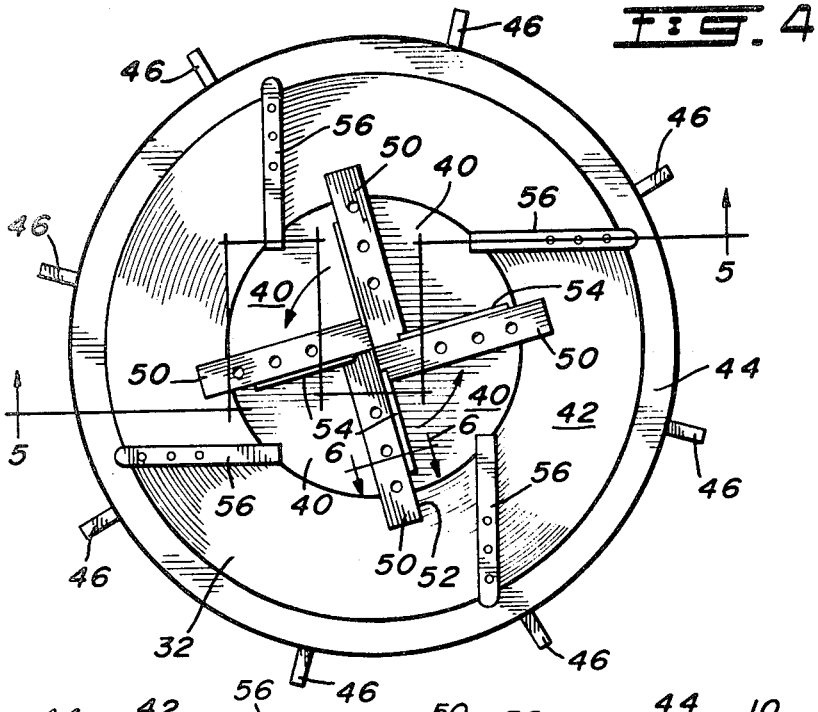
FIG. 4
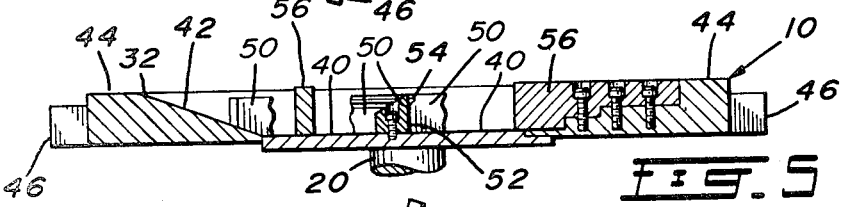
FIG. 5
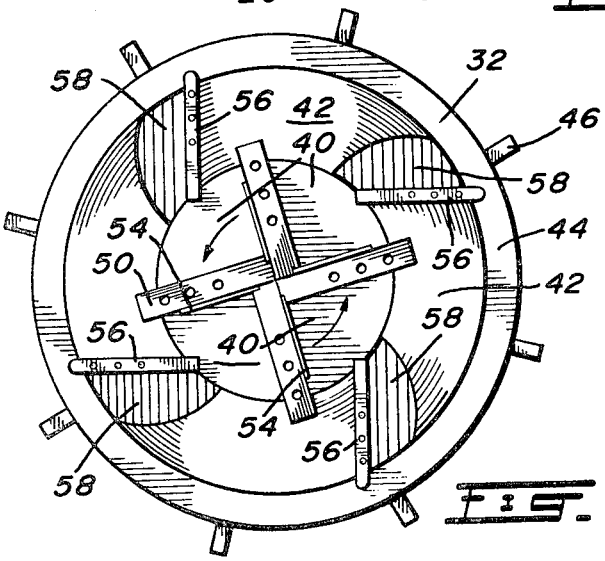
FIG. 6
FIG. 7

FIG. 8
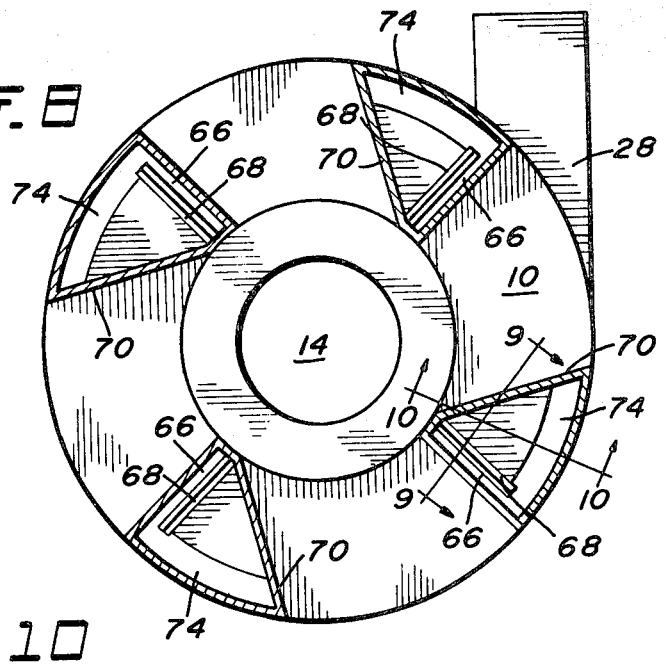
FIG. 10
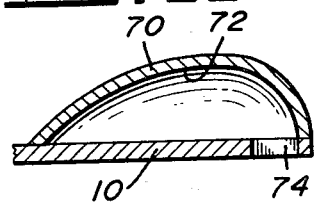
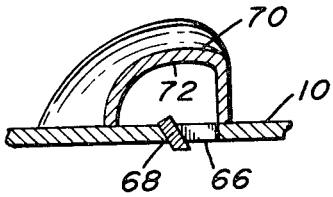
FIG. 9
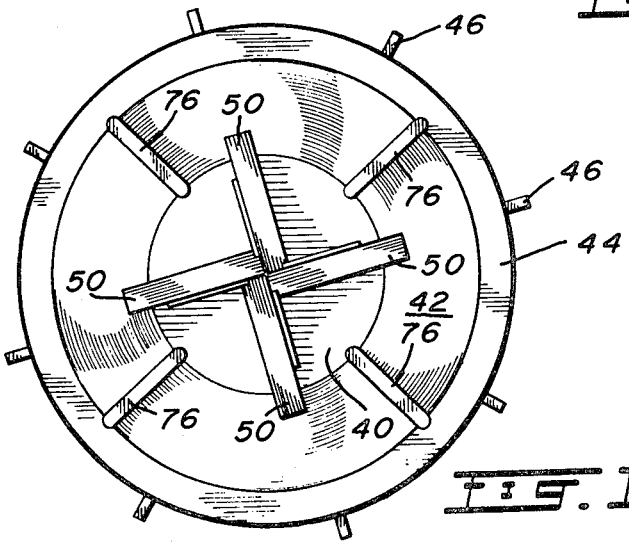
FIG. 11

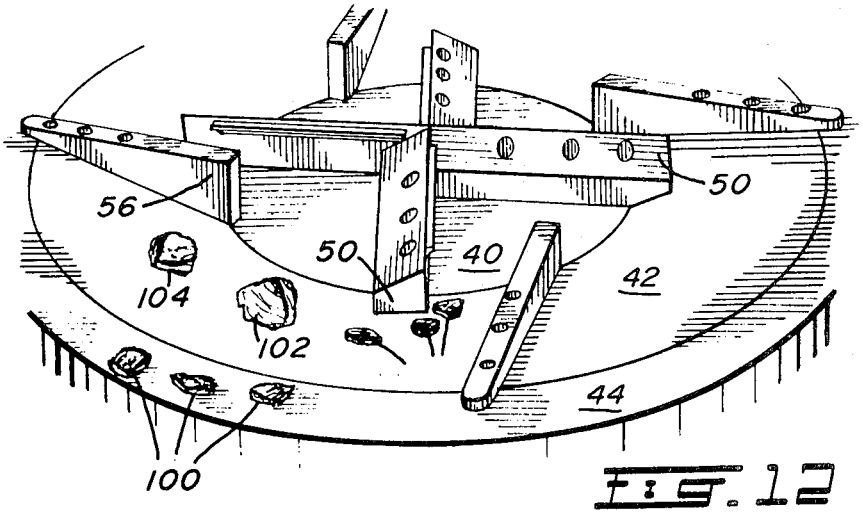
FIG. 12
FIG. 13
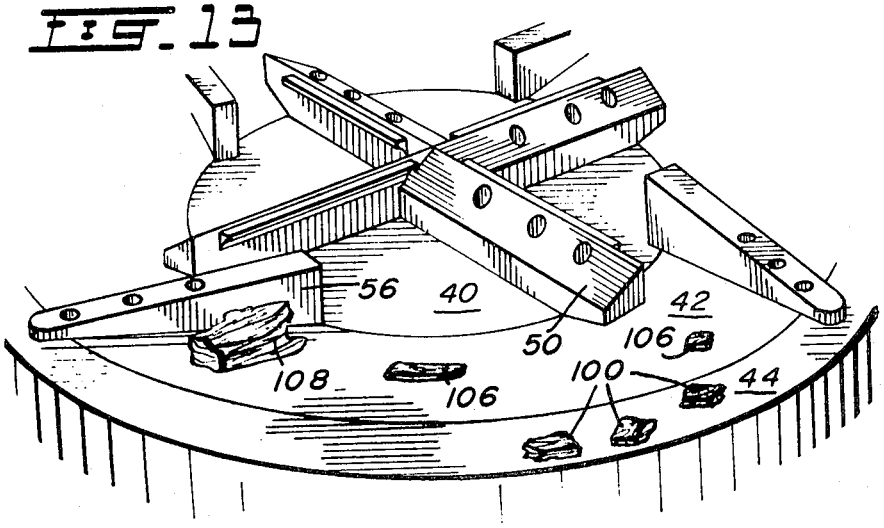

CHIP THICKNESS SEPARATOR

FIELD OF THE INVENTION

The present invention relates to a device for adjusting the thickness of wood chips or other material, more particularly the present invention relates to a device for separating wood chips or other material greater than a preset thickness and if desired reducing the thickness of the oversized material.

BACKGROUND TO THE INVENTION

In the manufacture of pulp and paper wood is usually chipped into particles generally known as chips via equipment known in the trade as a chipper. Many different types of chippers are available, however, the conventional chipper cuts across the wood at an angle to the grain to define the length of the chip, the thickness being determined by splitting along the grain and therefore despite the fact that much work has been done on designing the cutting angles etc. the thickness of the chips is not accurately controlled.

It is also known to cut with a plurality of discrete blades each extending substantially parallel to the grain thereby to produce what is known as wafer chips which are of relatively uniform thickness and have been proven to produce more uniform pulps requiring less cooking chemical for cooking.

However, if benefits are to be derived from the use of wafer chips substantially only wafer chips may be used to charge the digester and since current practice is to purchase chips from many suppliers, it is difficult, if not impossible, to economically purchase only wafer chips. Thus the benefits inherent in wafer chips are not normally available in the pulp mill.

It has also been proposed to screen the chips by thickness and then to slice the oversize chips to reduce the thickness of the chip to a predetermined maximum. One such device for slicing oversize chips is shown for example in U.S. Pat. No. 4,235,382 issued Nov. 25, 1980 to Smith.

BRIEF DESCRIPTION OF THE INVENTION

The object of the present invention is to provide a device that will classify chips according to thickness whereby the chips over a certain thickness will be separated from the remainder of the chips and further to provide means for reducing the thickness of the oversized chips if desired.

Broadly the present invention comprises a housing, a disc rotatable upon an axis of rotation in said housing, an axial inlet to said disc through said housing, means to feed of chips through said inlet, one face of said disc cooperating with a cooperating face on said housing to define a chip passage terminating adjacent the periphery of said disc in a chip outlet through which a predetermined thickness of chip may pass, chip orienting bars on said face of said disc facing said inlet and extending from said axis of rotation radially outward beyond the said chip inlet by a distance sufficient to accelerate chips entering adjacent the outer periphery of said inlet to a radial velocity leaving said bars approaching the radial volocity leaving said bars of material entering adjacent said axis and a frustro conical chip orienting surface extending radially outward from the radial extremeties of said orienting bars by a distance sufficient to permit said chips to be oriented against said orienting surface and in a position to intercept chips leaving radially from said orienting bars, said chip orienting surface and said cooperating surface defining a tapering portion of said chip passage narrowing toward said outlet so that the narrowest portion of said chip passage is said outlet.

If the above defined device is to be used to simply separate oversized chips from those of a preselected size as defined by the height of said outlet, an oversize outlet will be provided through said orienting surface trailing said orienting bars in the direction of rotation of said disc sufficiently behind the unobstructed trajectory of a chip leaving said orienting bar so that chips thicker than said predetermined thickness must be deflected from said unobstructed trajectory into said oversize outlet passage.

If the oversize chips are to be reduced in the device, breaker bars may be provided on said disc projecting from said orienting surface and cooperating with similar breaking bars projecting from said cooperating surface to shear oversized chips deviating from the unobstructed trajectory of the chips and engaging the breaker bars on said orienting surface.

In yet another alternative the breaker bars may be substituted for pusher bars mounted on said orienting surface behind said orienting bars so that oversized chips deflected from said unobstructed trajectory contact the pusher bars and slicing blades are substituted for the cooperating breaking bars on the cooperating surface, said slicing blades extend through said housing in position to slice oversize chips engaged by said pusher bars thereby to reduce the thickness of said oversized chips. The wood material sliced by said slicing blades passes out of the housing and is conveyed from the device. One way of conveying this material from the device is to redirect it back into said housing to be engaged by flinger means on the disc and be rejected tangentially from housing with the chips passing through said outlet passage.

BRIEF DESCRIPTION OF THE DRAWINGS

Further features, objects and advantages will be evident from the following detailed description of the preferred embodiments of the present invention taken in conjunction with the accompanying drawings in which:

FIG. 4 is a plan view of a rotor forming one embodiment of the present invention.

FIG. 5 is a section along the line 5—5 of FIG. 4.

FIG. 6 is a section along the line 6—6 of FIG. 4.

FIG. 7 is a view similar to FIG. 4 illustrating another embodiment of the present invention.

FIG. 8 is a plan view similar to FIG. 2 illustrating a modified form of the present invention.

FIG. 9 is a section along the line 9—9 of FIG. 8.

FIG. 10 is a section along the line 10—10 of FIG. 8.

FIG. 11 is a plan view of the disc used in the embodiment of FIG. 8.

FIGS. 12 and 13 illustrate the operation of the orienting mechanism of the present invention depicting how chips are positioned flatwise on the orienting surface of the disc.

DESCRIPTION OF THE PREFERRED EMBODIMENTS

Figure 1:
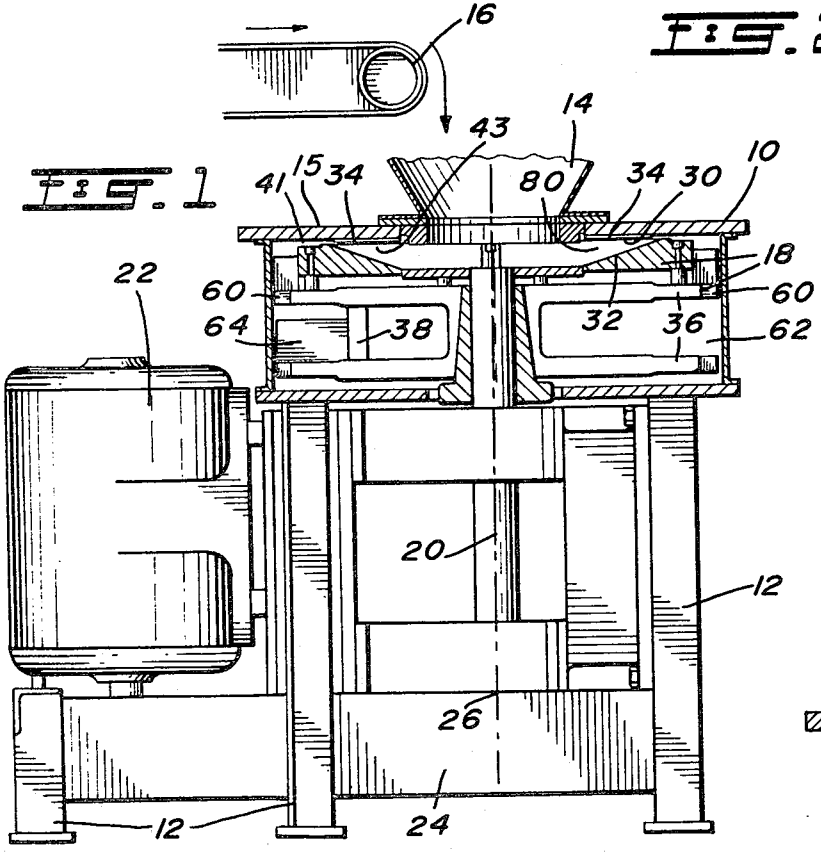
FIG. 1 is a vertical section of the present invention schematically illustrating the feed conveyor.

Referring to FIG. 1 the invention is generally composed of a housing indicated at 10 mounted on a suitable frame as indicated at 12. The housing 10 has an inlet 14 through the cover plate 15 and a suitable conveyor 16 delivers the chips into the inlet 14 at a rate coordinated with the rate of rotation of the disc 18 as will be described hereinbelow. It is important not to overfeed the device as the chips may not be properly oriented if the feed rate is too high. A tangential outlet 28 is provided from the housing 10.

The disc generally indicated at 18 is mounted within the housing 10 and rotates with axle 20 which is mounted in suitable bearings in the frame 12 and driven by motor 22 through belt drive 24 to spin the disc 18. It will be noted that the inlet 14 is axial relative to the rotational axis 26 of the shaft 20 and disc 18. Preferably the chips will fall in free flight down the inlet to permit some axial separation of the chips passing onto the disc 18 e.g. at least about 2 feet is preferred but not essential depending on feed rate. The speed of the disc has a direct influence on the maximum feed rate for chips.

Figure 2:
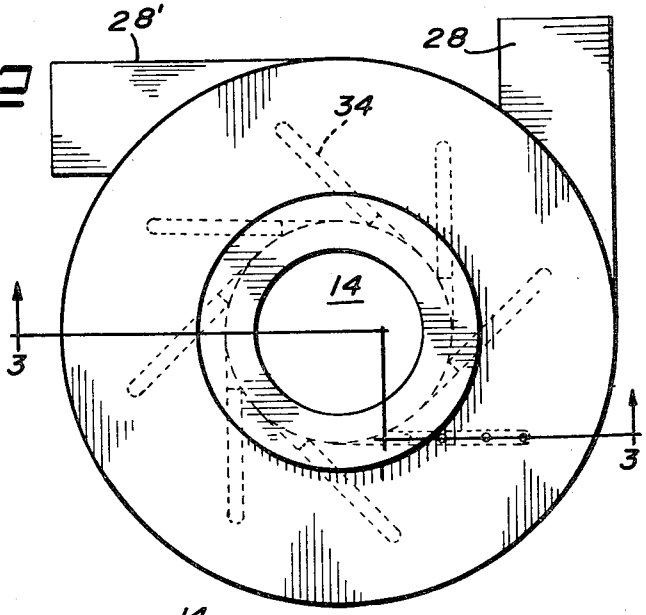
FIG. 2 is a plan view of one embodiment of the present invention showing breaker bars in hidden lines (dash lines) and the tangential outlet.
Figure 3:
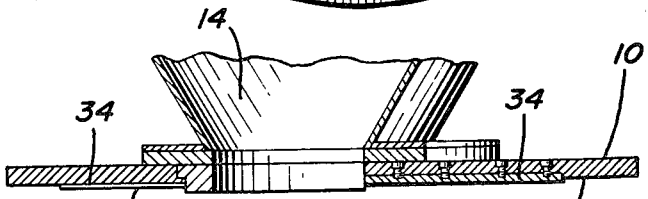
FIG. 3 is a section along the line 3—3 of FIG. 2.

As illustrated in FIG. 1, the housing 10 cover plate 15 has a cooperating surface 30 facing and cooperating with the working surface 32 of the disc. A plurality of shear bars 34 shown in dotted lines in FIG. 2 project from the surface 30 and are adapted to cooperate with bars on the disc in the embodiment illustrated in FIG. 4 in a manner to be described hereinbelow. In other embodiments, the shear bars 34 may be eliminated or replaced by other means.

The disc 18 in the arrangement illustrated in FIG. 1 is composed of a pair of spaced disc members 36 with suitable webbing 38 therebetween to provide a rigid deck for mounting the working instrumentalities of the disc.

As shown in FIG. 4 the working surface 32 of the disc 18 is composed of a central substantially flat circular section 40; a substantially frustro conical orienting surface 42 traversing the trajectory of chips passing through the device and an annular substantially flat radial section 44. The working surface 32 of the disc cooperates with the face 30 of the housing to define a passage 43 terminating in an outlet 41 (see FIG. 1) through which the chips pass. In the illustrated embodiment the outlet 41 is in the form of a passage having substantially parallel side walls defined by the annular surface section 44 on the disc 18 and the cooperating surface 30 of the housing to better ensure oversize chips do not escape, but if the section 44 is omitted and the diameter of the disc 18 and housing 10 reduced accordingly the device will still operate satisfactorily and the cost will be reduced accordingly. Suitable paddles or the like 46 are mounted around the periphery of the disc 18 and function to eject the chips of the accepted thickness through the tangential outlet 28.

As shown in FIG. 4, chip orienting bars 50 project from the working surface 32 towards the face 30 and extend from the axis of rotation of the disc radially outward across the face 40 and partway along the frustro conical orienting face 42. The height of these members 50 i.e. their length axially of the disc is such that they may accomodate the width of the chips fed thereto i.e. their height preferably is greater than the expected width of the chips to be fed thereto (the chips may have one dimension longer than the said height but it is preferred the other dimensions be smaller). For example with conventional wood chips used in the pulp and paper industry and having a nominal ⅝ inch length, a bar height of about 2 inches is satisfactory. The leading face 52 of each of the bars 50 is provided with a curved section adjacent its end closest the inlet 14 i.e. space farthest form the surface 40. These curved surfaces generally indicated at 54 in FIGS. 5 and 6 function to trap chips passing from the intlet 14 into a position in front of the bars 50 and impede movement back toward the inlet. These curved sections 54 as shown in FIG. 4 extend substantially the length of the bars 50 traversing the inlet 14 but normally not beyond the inlet or at least not beyond the beginning of the conical surface 42 and though they are preferred they may be omitted.

As above described, the orienting bars function to pump the chips entering through the inlet onto the orienting surface 42. The pumping action or centrifugal action applied to the chips tends to move them radially outward along the front face 52 of bars 50. Thus, the chips entering through inlet 14 slide along the surface 40 into contact with the bars 50 that accelerate the chips radially and cause them to move radially outward along the bars 50 thereby tending to separate the chips so that they move off the bar substantially in single file relationship and, in any event, in a manner to permit the chips to be oriented onto the surface 42. Obviously, this relationship and/or orientation cannot be obtained if too many chips are fed between adjacent orienting bars 50, thus, it is important to correlate the number of chips fed per unit time between the pair of bars with the speed of rotation of the disc. It is important to ensure that too many chips do not enter between the bars i.e. underfeeding is not a problem (other than reduced capacity) but overfeeding may well lead to interfering with orienting of the chips on the surface 42 i.e. they may attempt to stack more than one deep on the surface 42 and be treated as oversized material by the device. In the event this problem is encountered, and the rate of rotation of the disc is not to be increased it is simply necessary to reduce the rate of chip feed to the equipment so that the chips are more spread out which normally will simply reduce capacity. Alternatively, to a limited degree one could increase the number of bars 50 and thereby adjust the capacity, however, there are obvious limitations and sufficient space between the adjacent bars 50 must be maintained to permit the chips to enter properly.

When the chips contact the front face 52 of a bar 50 they tend to move, due to the forces applied to them by the bar, to a position with their main surface (largest ones) in face to face relationship with the front face 52. Thus, there is an initial orienting of the chip with its largest area face substantially parallel to the front face 52. The chips so oriented are ejected off of this front face in radial direction with their lower most edges contacting the conical orienting surface 42. It will be noted that the conical surface extends inward beyond the outer periphery of the orienting bars 50 so that as the chips are leaving the bars 50 they will normally have their bottom edges contacting the orienting surface 42.

Because the conical orienting surface 42 traverses the path of the chips as they pass off the orienting bars 50 (i.e. they are moving substantially radially outward on the bars 50), the lower edge of the chips must ride up the surface 42 which increases the force of the chip against the surface 42 thereby to increase the friction and reduce the slippage between the bottom edge of the chip and the surface 42 so that the speed of the bottom edge of the chip approaches the speed of the disc 18 and thus tends to travel faster as it moves radially outward than the upper edge which is free of contact and thereby turn the chip onto its large surface area face. A large chip contacts with the cooperating surface on the housing and is turned onto the surface 42. Thus both of these actions tip the chip onto its larger area face on the surface 42 i.e. the face that was moved against the front face 52 of the bar 50 is tipped to lie in face to face relationship with the surface 42, thereby ensuring that the chips are oriented on their largest cross-section area surface.

Obviously, it is important that there be sufficient space available for these chips to lay down flat. This can be ensured by carrying the chips far enough up the face 42 on the bars 50 i.e. the available area is increasing with the square of the radius and thus the longer the bars 50 the greater available area on the surface 42 between the bars. It is also important that the bars 50 be sufficiently long to extend well beyond the area of the inlet so that the chips must travel radially outward primarily along the surfaces 52 of the bars 50 for sufficient distance to permit even those chips entering adjacent the outer periphery of the inlet and immediately behind the immediately preceding bar 52 to engage the bar 52 and be accelerated to a radial velocity approaching the radial velocity of a chip that enters adjacent the axial centre line and passes in contact with substantially the full length of the bar. Obviously, there will be differences in these velocities but if the bars 50 extend beyond the area of the inlet by at least about 1 inch (depending on the size of the inlet) these differences normally will not be too significant. However, in some cases it will be advantageous to extend the bars even longer to insure there is ample room on the surface 42 to permit the chips to be oriented on the surface 42 even at maximum feed rate. There is a practical limit as well as a functional limit for the length of these bars 50 beyond the outer periphery of the inlet since after the chips have been on the bar for a certain length of time (depending on the speed of the bar or rpm of the disc) the separation of the chips or the alignment of the chips along the face does not change significantly and the available area on surface 42 is ample so that extending the bar further simply makes the device bigger with no attendant advantage.

Obviously, the radial length of the conical surface 42 must be sufficiently long to permit the above described action of turning the chip onto its face on the surface 42 to occur and for the chip to travel in this position for a short distance before it reaches the outlet 41 to provide room for the oversize material to move into engagement with the cooperating surface 30 on the housing and slide circumferentially on face 42.

The elements on the disc as described hereinabove may be substantially the same in all of the embodiments of the invention.

In the embodiment illustrated in FIG. 4 suitable disc breaker bars 56 are mounted on the orienting surface 42 of disc 18 trailing the orienting bars 50 in the direction of rotation. It is important that these bars be significantly behind the bars 50 so that a chip thrown out from between the bars 50 on a substantially unobstructed trajectory (with the exception of the obstruction by contact with the surface 42) would not approach the bars 56 while chips too thick to pass through the outlet 41 slide along the surface 42 until they engage the bar 56. This bar 56 positively advances such a chip at the speed of the bar 56 and forces same against the shear bars 34 on the working face 30 of the housing 10 to reduce the thickness of the chip. The material severed by this action is forced to the opposite side of the bar 56 and proceeds by centrifugal force radially outward to leave the disc through the outlet 41. If the material pushed against bars 56 is not sufficiently reduced by the action of the first shear bar 34 it will move radially outward along the bar 56 after the first bar 34 passes until it again contacts cooperating surface 30 and is held and the next shear bar 34 reduces its thickness. This action of the bars 34 cooperating with the bars 56 to reduce the oversize material will be repeated until the material is small enough and passes out through the outlet 41. The paddles 46 eject the material passing through outlet 41 from the housing 10 through the oulet 28.

In the embodiment shown in FIG. 7 instead of the oversized material being sheared by cooperation of the breaker bars 56 with the bars 34, the oversized material travels circumferentially along the surface 42 and falls out through the outlet 58 through the surface 42 located immediately ahead of the bars 56. Material falling through the outlet 58 passes into the area between the flanges 36 and is ejected out of the housing through a second tangential outlet generally indicated at 28'. The second outlet 28' is completely isolated from the outlet 28 via the partition generally indicated at 60 in FIG. 1. This partition 60 may be an integral part of the housing 10 or may be simply a projection of the upper disc member 36 into close proximity with the inner surface of the housing 10 to stop material passing through the outlet passage 41 from falling into the area generally indicated at 62, in FIG. 1. Suitable paddles such as those indicated at 64 may be used to eject material passing through outlet 58 through outlet 28' (see FIG. 1).

In FIG. 8 the top of the machine or housing 10 is modified as is the disc.

As illustrated in FIG. 8 which is a radial section taken just above the top of the housing 10 suitable slots 66 are formed in the top surface of the housing 10 through the working face 30 and a suitable slicing blade 68 immediately trails each such slot 66 (four such openings and blades have been shown). Each of the slots 66 and blades 68 are contained within a housing at 70 projecting from the upper surface of the housing 10. Each such housing 70 is formed with an inner deflecting surface 72 to direct the material cut by the blade 68 and passing through slots 66 outward towards the outer periphery of the housing 10 and through the opening 74 back into the housing 10 for ejection by the paddles 46.

In the FIGS. 8 to 11 embodiment the disc 18 has been modified so that the breaker bars 56 are replaced by pusher bars generally indicated at 76. These pusher bars extend substantially radially to cooperate with the cutting knives 68. The bars 76 push oversized material that comes in contact therewith against the blade 68 to insure the same is cut. Obviously as in the previous embodiment the chips with a thickness less than the height of the outlet 41 pass directly out of the machine without being cut by the knives 68 while the overthick chips are reduced one or more times by the blade 68 until they are sufficiently thin to pass through outlet 41.

It is believed that the operation of the equipment will be evident in the above description but reference will now be made to FIGS. 12 and 13 which show how it is believed the chips may be oriented.

As shown in FIGS. 12 and 13 the chips are metered into the inlet 14, fall in front of the bars 50 and are engaged by the front face 52 of the bars 50 which due to the movement of the bars relative to the chips tend to orient the chips with their larger area aligned with the front face 52 e.g. their surfaces of largest area align with and probably contact the face 52. Curved section 56 at the end of the bar 50 closest to the inlet 14 aids in impeding the chips falling in front of the bar 50 from passing back up i.e. moving axially to the disc back towards the inlet 14. Chips slide along the front face 52 of the bar 50 and pass off the end via centrifugal force. These chips tend to align themselves one behind the other on the bar and to leave the bar in what might be described as single file one after another. Alignment of the largest faces of the chips with the faces 52 is obtained by proper rate of feed of the chips through the inlet and, as above described, the length of the bars 50. If the feed is too fast for the speed of rotation of the disc the chips will not be moved radially outward quickly enough and too many will pile one on the other against the orienting bars 50 and the proper orienting of the chips against surface 52 may not be attained. If this occurs the rate of feed should be decreased or the speed of rotation of the disc increased to obtain proper operation. Obviously, there are pratical limitations on the maximum speed of the disc.

The chips move along and off the bars 50 and their lower edges engage the surface 42 which defines one side of a tapering gap as indicated at 80 in FIG. 1 and as above described they are laid over onto their larger area faces on the surface 42, whereby each chip is oriented so that it is resting generally on its largest area face with the dimension perpendicular thereto being the thickness of the chip. Assuming the chip is of thickness to pass through the tapered gap 80 and out through the outlet 41 the chip will follow a generally preset substantially unobstructed trajectory. If the chip is oversized and positioned as above described it cannot proceed up the conical surface 42 i.e. through the tapering portion 80 of the chip passage 43, it slides circumferentially along the surface 42 until it reaches either a breaker bar such as that indicated at 56 shown also in FIGS. 12 and 13 or the pusher bar 76 or the opening 58 i.e. the chips will normally follow the trajectories as indicated by the chips 100 in FIGS. 12 and 13 or if they are oversize will be deflected from these trajectories and will move circumferentially along the paths as indicated by the position of the chips 102 and 104 in FIG. 12 and 106 and 108 in FIG. 13. These oversized chips 102 to 108 inclusive contact the breaker bar 56 or pusher bars 76 or pass out through the openings 58 depending on which embodiment of the invention is being employed.

Throughout the disclosure reference has been made to wood chips but while the invention is specially suited for wood chips other suitable materials may be classified and/or reduced therein.

Having described the invention modifications will be evident to those skilled in the art without departing from the spirit of the invention as defined in the appended claims.

It is claimed:

1. A device for separating discrete pieces of material having a thickness defined by the spacing between two major surfaces such as wood chips by thickness comprising, a housing, a disc rotatable on an axis of rotation in said housing; an axial inlet to said disc through said housing, means to feed said material through said inlet, a face of said disc cooperating with an operating face on said housing to define a passage between said housing and said disc, said passage terminating in an annular outlet adjacent to periphery of said disc, said outlet having a height determining maximum thickness of material that may pass therethrough, orienting bars on said face of said disc facing said inlet and extending from said axis, of rotation radially outward beyond said inlet by a distance sufficient to accelerate material entering adjacent the outer periphery of said inlet to a radial velocity leaving said bars approaching the radial velocity leaving said bars of material entering adjacent said axis, a fustro conical orienting surface extending radially outward from the radial extremities of said orienting bars by a distance sufficient to permit said material to be oriented with one of said major surfaces against said orienting surface and in a position to intercept material moving radially from said orienting bars, said orienting surface and the operating face of said housing defining a tapering portion of said passage narrowing towards said outlet.

2. A device as defined in claim 1 wherein said orienting bars extend beyond said inlet by a distance of at least 1 inch.

3. A device as defined in claim 1 wherein said orienting bars project from said disc toward said inlet at least in the area of said inlet by a distance at least as long as a nominal length of said material.

4. The device as defined in claim 1 further comprising an oversized outlet through said orienting surface in a position trailing each of said orienting bars in the direction of rotation of said disc behind a substantially unobstructed trajectory of material flung from between said orienting bars by an amount sufficient so that material thicker than said predetermined thickness will engage both faces of said tapered portion of said passage and be deflected from said unobstructed trajectery into said oversize outlet.

5. Devices defined in claim 1 further comprising breaker bars mounted on said disc and projecting from said orienting surface toward the cooperating face on said housing, one of said breaker bars trailing each of said orienting bars in the direction of rotation said disc behind a substantially unobstructed trajectory of material leaving said orienting bars sufficiently so that material thicker than said predetermined thickness will engage said orienting surface and said operating face on said housing defining said tapering portion of said passage and be deflected from said substantially unobstructed trajectory into contact with said breaker bar on said disc, cooperating breaking bars fixed to said housing and adapted to cooperate with said breaker bars on said disk to reduce oversized material sufficiently to pass through said outlet.

6. A device is defined in claim 1 further comprising pusher bars projecting from the said orienting surface, one of said pusher bars positioned trailing each of said orienting bars in the direction of rotation to said disc behind a substantially unobstructed trajectory of material leaving said orienting bar sufficiently so that material thicker than said predetermined thickness engages said orienting surface and the operating face of said housing defining said tapering proportion of said passage and is deflected from said substantially unobstructed trajectory into contact with said pusher bars, slicing knives extending through slots in said housing into said passage to cooperate with pusher bars to slice material engaged by said breaker bars.

7. Device is defined in claim 6 further comprising a housing means surrounding each of said knives in a position and adapted to deflect material cut by said knives and passing through said slots radially outward relative to said disc to pass through an aperture provided in said housing back into said housing for ejection from said housing with material passing through said outlet.

8. A device as defined in claims 1, 2 or 3 wherein said outlet is defined by substantially parallel faces on said disc and said housing.

9. A device as defined in claims 5 or 6 wherein said outlet is defined by substantially parallel faces on said disc and said housing.

* * * * *